US006933895B2

(12) United States Patent
Mendolia et al.

(10) Patent No.: US 6,933,895 B2
(45) Date of Patent: Aug. 23, 2005

(54) NARROW REACTIVE EDGE TREATMENTS AND METHOD FOR FABRICATION

(75) Inventors: Greg S. Mendolia, Ellicott City, MD (US); Shawn Rogers, Jessup, MD (US); William E. McKinzie, III, Fulton, MD (US)

(73) Assignee: E-Tenna Corporation, Laurel, MD (US)

( * ) Notice: Subject to any disclaimer, the term of this patent is extended or adjusted under 35 U.S.C. 154(b) by 173 days.

(21) Appl. No.: 10/367,179

(22) Filed: Feb. 14, 2003

(65) Prior Publication Data

US 2004/0160367 A1 Aug. 19, 2004

(51) Int. Cl.[7] ..... H01Q 1/24
(52) U.S. Cl. ..... 343/702; 343/909; 343/700 MS
(58) Field of Search ..... 343/700 MS, 702, 343/756, 853, 909

(56) References Cited

U.S. PATENT DOCUMENTS

| | | | | |
|---|---|---|---|---|
| 6,262,495 | B1 | 7/2001 | Yablonovich et al. | 307/101 |
| 6,483,481 | B1 * | 11/2002 | Sievenpiper et al. | 343/909 |
| 6,512,494 | B1 | 1/2003 | Diaz et al. | 343/909 |
| 6,628,242 | B1 * | 9/2003 | Hacker et al. | 343/909 |

OTHER PUBLICATIONS

Diaz, Rodolfo E. et al., "TM Mode Analysis of a Sievenpiper High–Impedance Reactive Surface", *IEEE Antennas and Propagation Symposium*, Salt Lake City, Utah, 2000, 25 pages.

Kamgaing, Telesphor et al., "A Novel Power Plane With Integrated Simultaneous Switching Noise Mitigation Capability Using High Impedance Surface", *IEEE Microwave and Wireless Components Letters*, vol. 13, No. 1, 2003, pp. 21–23.

Eugene F. Knott et al., "Chapter 9—Radar Absorbers", *Radar Cross Section—It's Prediction, Measurement and Reduction*, published by Artech House, Inc., copyright 1985, 239–272.

Sievenpiper, Daniel F., "High–impedance electromagnetic surfaces," Ph.D. dissertation, UCLA electrical engineering department, submitted Jan. 1999, 161 pages.

Magnetic Properties, Arc Technologies, Inc., "MAGRAM Thickness vs Frequency", obtained at the internet address: http://www.arc–tech.com/app3.html, printed on Apr. 4, 2003, 1 page.

Multi Band Magnetic Absorbers, Arc Technologies, Inc., "Multi Band and Technical Data Sheets", obtained at the internet address: http://www.arc–tech.com/mag2.html, printed on Apr. 4, 2003, 3 pages.

Single Band Magnetic Absorbers, Arc Technologies, Inc., "Single Band and Technical Data Sheet", obtained at the internet address: http://www.arc–tech.com/mag1.html, printed on Apr. 4, 2003, 2 pages.

Sprayable Magram Absorber, Arc Technologies, Inc., "Sprayable", obtained at the internet address: http://www.arc–tech.com/mag4.html, printed on Apr. 4, 2003, 1 page.

Typical Dielectric Properties, Arc Technologies, Inc., "Dielectric Properties of MAGRAM", obtained at the internet address: http://www.arc–tech.com/app4.html, printed on Apr. 4, 2003, 2 pages.

(Continued)

*Primary Examiner*—Hoang V. Nguyen
(74) *Attorney, Agent, or Firm*—Brinks Hofer Gilson & Lione

(57) ABSTRACT

An electromagnetic bandgap material is electrically attached to an edge, and enables high isolation between antennas due to the attenuation of surface waves. The disclosed embodiments further provide narrow reactive edge treatments in the form of artificial magnetic conductors (AMCs) whose physical width is less than 1/10 of a free space wavelength for the frequency of surface currents intended to be suppressed. These embodiments still further provide several AMCs suitable for this purpose, along with several exemplary manufacturing techniques for the AMCs.

26 Claims, 11 Drawing Sheets

OTHER PUBLICATIONS

R&F Products—RF MAG Microwave Absorber, R&F Products, "Absorber Products Type RF MAG", obtained at the internet address: http://www.randf.com/rf_mag.html, printed on Apr. 4, 2003, 2 pages.

English, Errol K., "Tapered Periodic Surfaces: A Basic Building Block for Broadband Antenna Design", *Ultra–Wideband, Short–Pulse Electromagnetics 2*, Plenum Press, New York, 1995, pp. 227–235.

* cited by examiner

FIG. 3
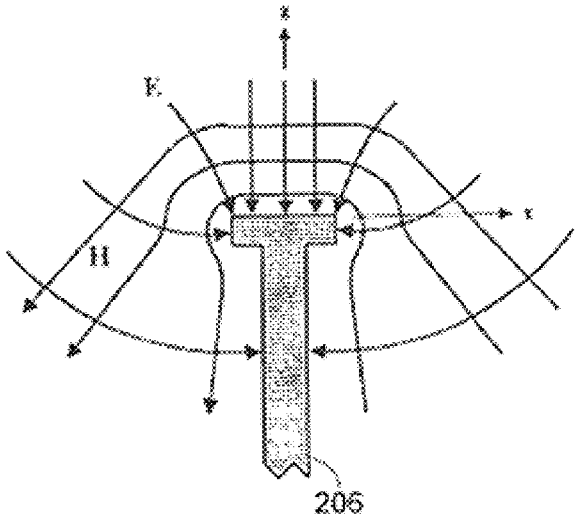
FIG. 4
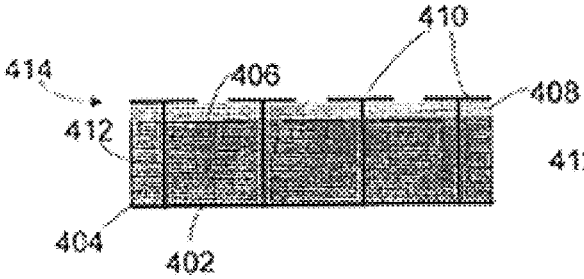
FIG. 5
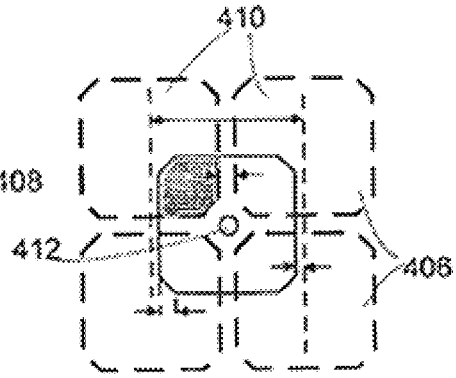
400
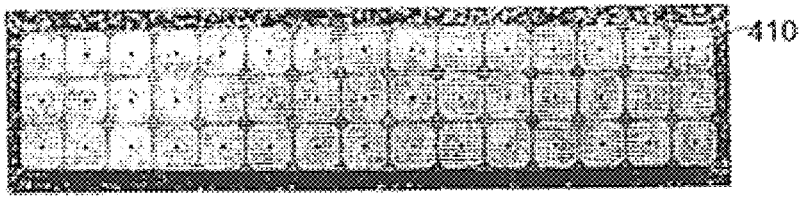
600
FIG. 6

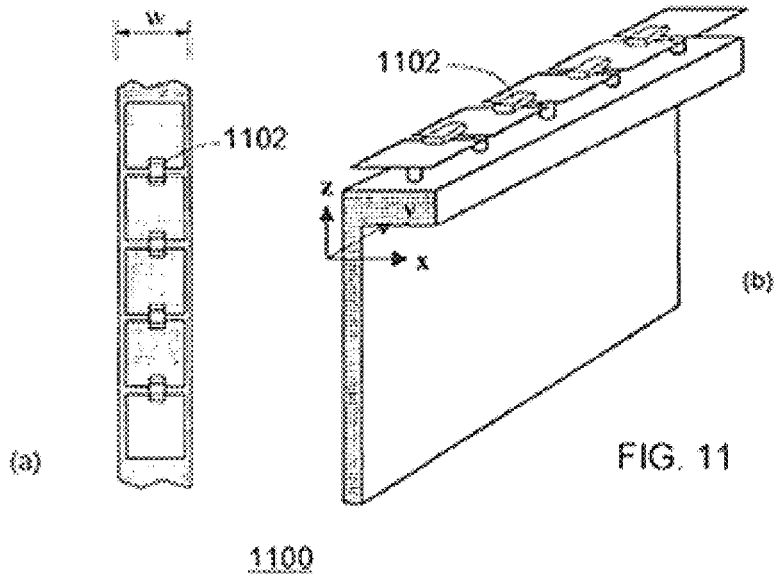
FIG. 11
FIG. 12
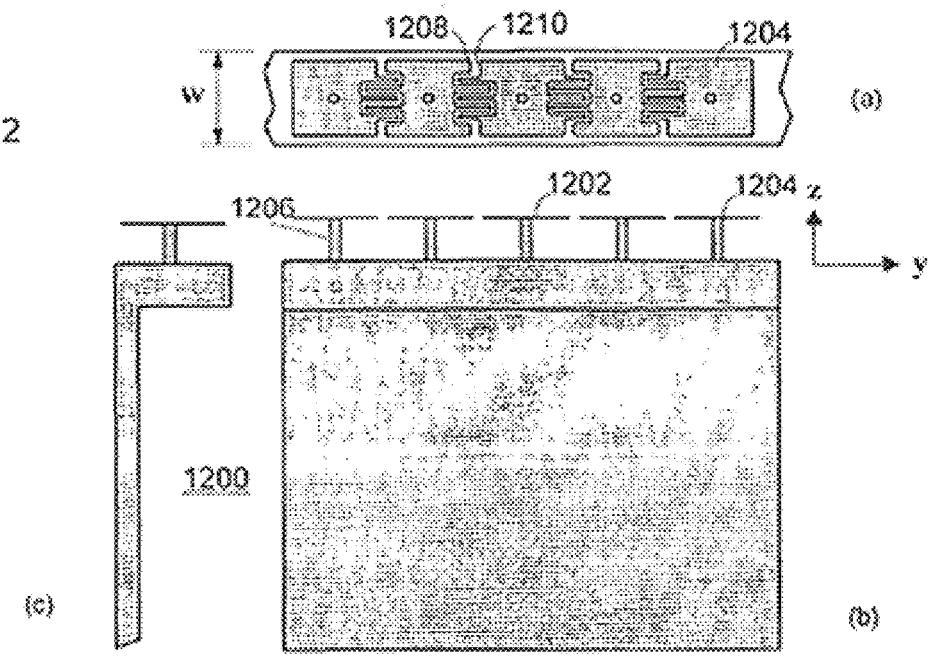

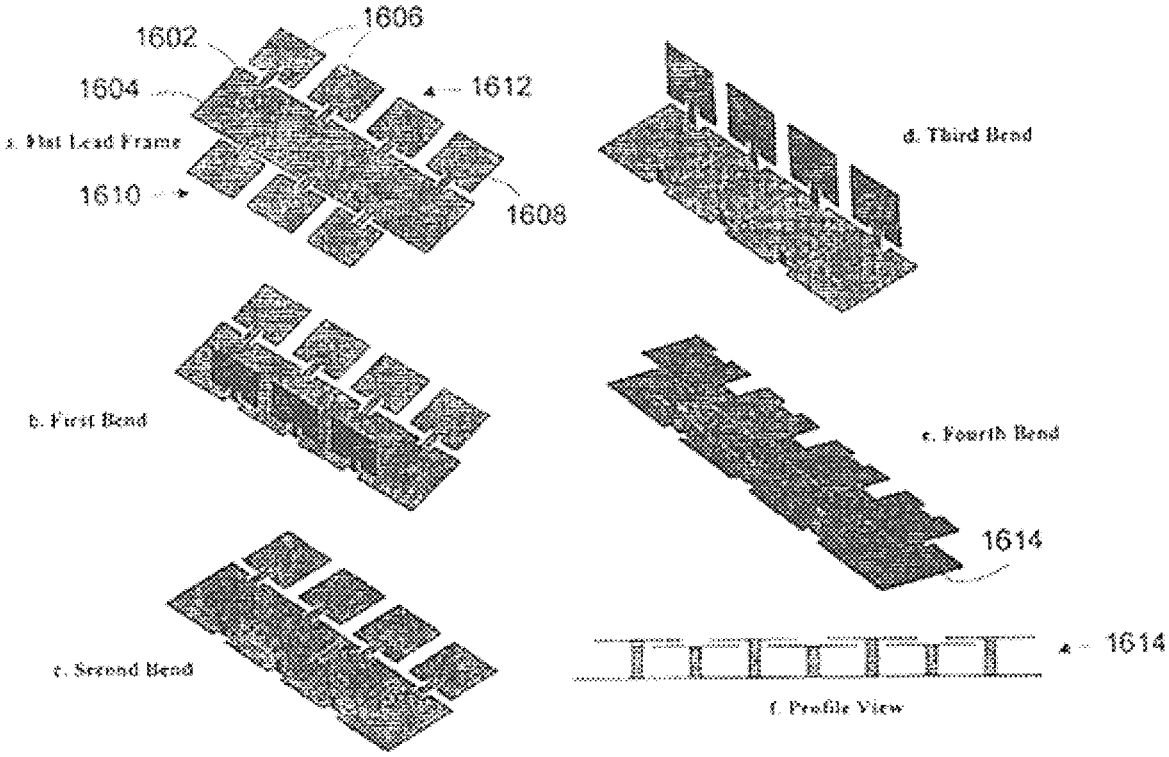
1600 FIG. 16

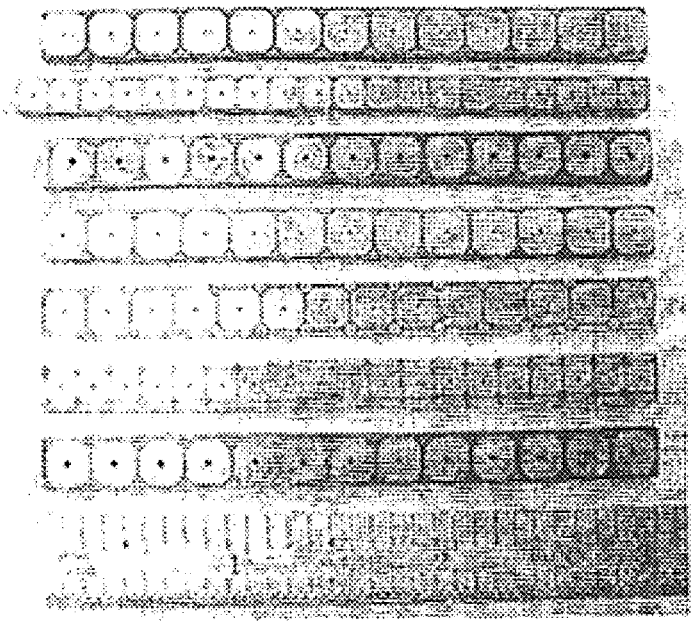
1. EC 1700-093-232-20
2. MC 2300-093-156-10
3. MC 2000-093-228-30
4. MC 1700-093-332-20
5. SQR 093A
6. MC 2300-093-156-7
7. MC 2000-093-228-27
FIG. 17
FIG. 18
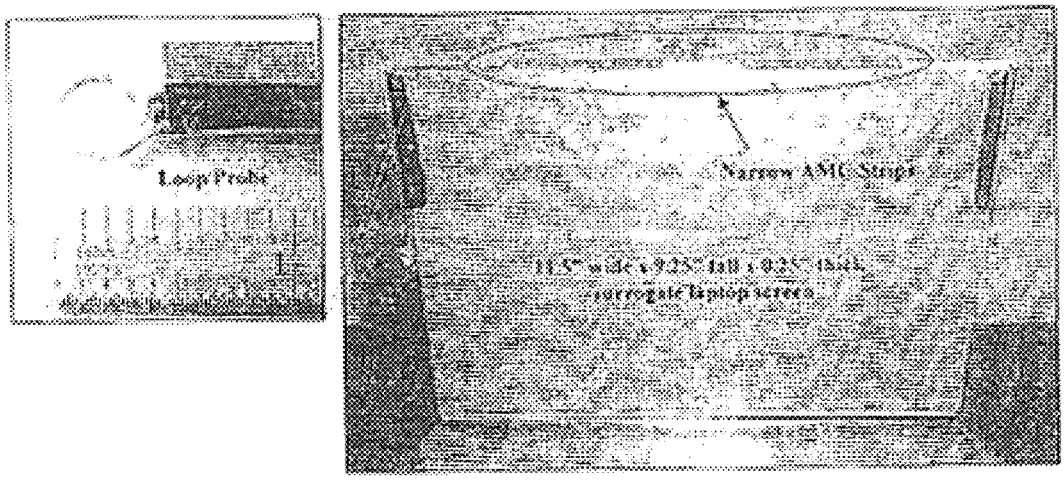

NARROW REACTIVE EDGE TREATMENTS AND METHOD FOR FABRICATION

BACKGROUND

The present invention relates generally to electromagnetic bandgap materials for isolating antennas. More particularly, the present invention relates to narrow reactive edge treatments and methods for manufacturing the same. One embodiment of the invention is a surface treatment that may be applied to laptop computers or other wireless devices.

In many applications, two or more adjacent antennas may couple energy in an undesirable fashion. The coupling reduces the efficiency of all antennas involved and may drastically limit the range and reliability of radio devices using the antennas.

One particular application which requires multiple antennas is a laptop computer with Bluetooth and wireless local area network (WLAN) capabilities. Bluetooth is a wireless data communication standard operating at approximately 2.4 GHz with a range of approximately 10 meters. WLAN data standards include a group of standards propounded by the Institute of Electrical and Electronics Engineers (IEEE) and generally called 802.11. These include IEEE standard 802.11b, also operating at 2.4 GHz. Both Bluetooth and WLAN standards such as 802.11b allow high-speed data communication for mobile device such as laptop computers.

Both Bluetooth and WLAN standards such as 802.11b allow high-speed data communication for mobile devices such as laptop computers. Many such devices will be equipped with transceivers and antennas for both technologies. Electrical standards are under development to define the electrical interoperation of these radio devices. The required minimum isolation between antennas for simultaneous operation of Bluetooth and 802.11b WLAN radios is generally acknowledged to be between 30 dB and 40 dB. Untreated antennas typically exhibit 15 dB to 25 dB of isolation when installed on a laptop.

FIG. 1 illustrates coupling of energy between antennas mounted on a mobile device 100. In the example of FIG. 1, a first antenna 102 and a second antenna 104 are mounted at the periphery 106 of the metal housing 108 of the display portion 110 of a laptop computer. The laptop computer also includes a base portion (not shown) to which the display portion is mounted, the base portion typically including a case containing a motherboard, keyboard and other conventional laptop components.

The conductive metal housing or chassis 108 provides a surface where electric fields can attach. FIG. 1 illustrates vertical electric field lines 112. Energy is propagated from one antenna 102, 104 to the other antenna 104, 102 through waves set up by the electric fields represented by the electric field lines 112. Energy can be propagated in both directions, from the first antenna 102 to the second antenna 104 and from the second antenna 104 to the first antenna 102. The effect is to increase mutual coupling between antennas.

Surface treatments have been developed to promote isolation between antennas such as the antennas 102, 104. A first example surface treatment is made of magnetic radar absorbing material (MAGRAM). This is typically an elastomeric material such as rubber or silicon or urethane that has been loaded with small magnetic particles such as carbonyl iron or ferrite powers. The drawbacks with this solution include the mass of the MAGRAM material. The surface treatments are relatively heavy even for thin MAGRAM, typically 1 to 3 pounds per square foot for thicknesses of 0.062 inches to 0.20 inches. Also, the MAGRAM absorbs radio frequency (RF) energy rather than re-directing the energy. This will degrade antenna efficiency when placed within the antennas near field.

Additional surface treatments that are capable of suppression of transverse magnetic (TM) mode surface waves include carbon loaded foam and semi-conductive honeycomb core materials. However, both of these classes of materials require a relatively thick absorber to be effective, often one-quarter to one-half of a free-space wavelength in thickness. Also, as with the MAGRAM material, these materials are RF absorbers that will degrade antenna efficiency when used in the near field of an antenna.

Accordingly, there is a need for an improved edge treatment for isolating two or more antennas, particularly on a mobile device such as a laptop computer. What is needed is a surface treatment that does not absorb radio frequency energy, but re-directs energy away from the treated surface, is relatively low profile and light weight for mobile applications, and can be mass produced using mature manufacturing processes.

BRIEF SUMMARY

By way of introduction, the present invention provides an electromagnetic bandgap material that enables high isolation between antennas due to the attenuation of surface waves. The present invention further provides narrow artificial magnetic conductors (AMCs) whose physical width is less than 1/10 of a free space wavelength for the frequency of surface currents of interest. The present invention still further provides several embodiments of AMCs suitable for this purpose, along with several exemplary manufacturing techniques for the AMCs.

An AMC is an electrically thin, loss-less, reactive material that exhibits a high surface impedance and attenuates surface waves over a specific bandwidth. In this application, the AMCs are nominally $\lambda/50$ in thickness. The ability of an AMC to suppress surface currents at frequencies within its bandgap and without degrading the efficiency of nearby antennas makes it attractive for applications where low mutual coupling between closely spaced antennas is required. One such application is in wireless devices that have 802.11 and Bluetooth radios.

The foregoing summary has been provided only by way of introduction. Nothing in this section should be taken as a limitation on the following claims, which define the scope of the invention.

BRIEF DESCRIPTION OF THE DRAWINGS

FIG. 3 illustrates an example of transverse magnetic fields near a conducting edge;

FIG. 4 is a cross section view of a reactive edge treatment in accordance with one embodiment of the present invention;

FIG. 5 is a top view of the reactive edge treatment of FIG. 4;

FIG. 6 is a photograph of a reactive edge treatment manufactured in accordance with the embodiment of FIGS. 4 and 5;

FIG. 11 illustrates another embodiment of a printed circuit reactive edge treatment employing chip capacitors to raise series capacitance;

FIG. 12 illustrates a reactive edge treatment that uses interdigital capacitors to raise the series capacitance between adjacent patches;

FIG. 16 illustrates assembly steps to create a narrow AMC edge treatment by folding a planar metal surface;

FIG. 17 is a photograph showing different AMC designs used to experimentally investigate AMC-based edge treatments;

FIG. 18 shows an experimental setup used to measure additional isolation from edge treatments;

DETAILED DESCRIPTION OF THE PRESENTLY PREFERRED EMBODIMENTS

The present invention provides a reactive circuit intended to be integrated into, or attached to, the edge of a conductive ground plane or electrically thin conductive surface. Its purpose is to act as a choke for electric currents that can flow tangential to the edge of the conductive surface. The most common reason for such currents to exist is because they travel along with a radiated electromagnetic wave that is launched from an antenna located on or near the edge of the ground plane. By choking edge currents, one can increase the isolation between two antennas located on or near the edge of the ground plane without reducing the performance of the antennas.

The present invention makes use of materials that may be characterized as artificial magnetic conductors. An artificial magnetic conductor (AMC) offers a band of high surface impedance to plane waves, and a surface wave bandgap over which bound, guided transverse electric (TE) and transverse magnetic (TM) modes cannot propagate. TE and TM modes are surface waves that attach to the surface of the AMC, whose Poynting vector is parallel with the plane of the AMC. The dominant TM mode is cut off and the dominant TE mode is leaky in this bandgap. The bandgap is a band of frequencies over which the TE and TM modes will not propagate as bound modes. One example of an AMC is disclosed in U.S. Pat. No. 6,512,494, issued Jan. 28, 2003 in the names of Rodolfo E. Diaz, et al., entitled MULTI-RESONANT, HIGH-IMPEDANCE ELECTROMAGNETIC SURFACES and commonly assigned to the assignee of the present application. The referenced patent is incorporated herein in its entirety.

Figure 2:
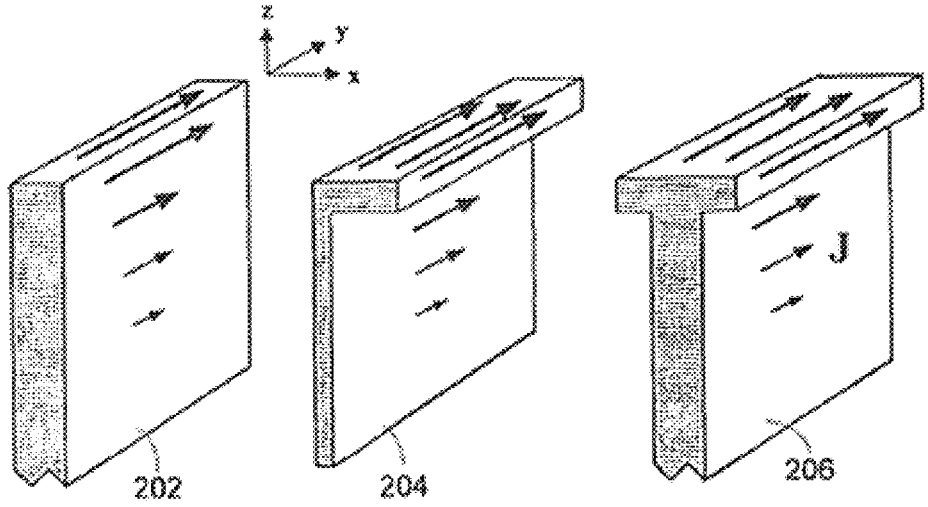
FIG. 2 illustrates common configurations for conductive edges and tangential surface current density therein.

Referring again to the drawing, FIG. 2 illustrates common configurations for conductive edges and tangential surface current density therein. The tangential surface current density $J_y$ in A/m is illustrated by the arrows in FIG. 2. The direction and size of the arrows is representative of the direction and relative magnitude of the tangential current density. Three exemplary conductive edges 202, 204, 206 are shown in FIG. 2. Edge 202 is rectangular in cross section. Edge 204 is L-shaped in cross section. Edge 206 is T-shaped in cross section. It is to be understood that edges may have any shape cross section, or combination of cross sections. In FIG. 2, coordinate axes relate the geometries as discussed herein.

In each of the edges 202, 204, 206, the tangential currents (defined as currents flowing parallel to the edge) have the greatest current density at the edges, and the amplitude tapers off toward the interior of the conductor. The surface currents to be attenuated correspond to transverse magnetic (TM) surface wave modes. An example of such fields is shown in FIG. 3. FIG. 3 illustrates an example of transverse magnetic fields near the conducting edge 206 of FIG. 2. Assume that power flows in the +y direction. The electric field $\vec{E}$ has only a component normal at the conducting surface, in the x-z plane. The magnetic field $\vec{H}$ is normal to the electric flux lines, and satisfies the boundary condition $\vec{J}=\hat{n}\times\vec{H}$ at the conducting surface.

FIG. 4 is a cross section view of a reactive edge treatment 400 in accordance with one embodiment of the present invention. FIG. 5 is a top view of the edge treatment 400 of FIG. 4. The reactive edge treatment 400 includes a ground plane 402, a dielectric layer 404 disposed on the ground plane 402, a first layer of patches 406, a dielectric spacer layer 408 and a second layer of patches 410. In the illustrated embodiment, the patches 410 of the second layer are connected to the ground plane 402 by vias 412. The layers of patches 406, 410, in conjunction with the dielectric spacer layer 408, form a frequency selective surface (FSS) 414.

A variety of materials can be used to form the reactive edge treatment 400. One method for forming the reactive edge treatment involves use of a printed circuit board (PCB) as a substrate. In one exemplary embodiment, the bottom or first layer of patches 406 is formed of solid copper formed on a 2.36 mm thick FR4 board with a 0.13 mm thick prepreg. The FR4 board forms the dielectric layer 404. The FR4 board has a copper ground plane 402. The patches 406 of the bottom or first layer are offset by one-half period from the patches 410 of the second or top layer as shown in FIG. 5. A 0.051 mm thick polyimide layer forms the dielectric spacer layer 408. The thickness of the FSS 414 is 0.051 mm. The thickness of the FR4 and ground plane is 2.49 mm. The pitch or period of the patches 406, 410 is 3.96 mm. The space between the first layer patches 406 is 0.25 mm and the space between the second layer patches 410 is 12.5 mm. These dimensions are exemplary only. The dimensions and shapes of the patches, along with other geometrical features and the materials used in the reactive edge treatment 400 may be chosen to fulfill particular design requirements.

The patches and the polyimide layer between them form a capacitive frequency selective surface (FSS) 414. For manufacturing, in one embodiment, the FSS 414 starts out as a dielectric sheet with copper on both sides. After etching the copper to define the patches, the FSS 414 is laminated onto a 2.36 mm thick FR4 board. The FR4 board has a copper ground plane on the side away from the FSS. In this design, only the top copper patches 410 are connected to ground through 20-mil diameter vias 412. The vias 412 are created by drilling and plating holes. The vias are substantially perpendicular to both the planes of the patches and the ground plane and may therefore be referred to as orthogonal conductors. These orthogonal conductors may be provided in any other form, such as by pressing rod-shaped conductors through the reactive edge treatment 400.

FIG. 6 is a photograph of one embodiment of a reactive edge treatment 600. The edge treatment 600 includes an array of 3×15 top layer patches 410. This arrangement is exemplary only. Any suitable geometries and arrangement may be chosen, and a few of the many alternative examples will be described below in conjunction with FIGS. 9–13.

In the preferred embodiment, the substrate of the reactive edge treatment has a width which is less than 1/10 of a free space wavelength at frequencies where the reactive edge treatment inhibits flow of edge currents in the electrically conductive edge. More generally, the reactive edge treatment must be electrically small compared to the frequencies of interest. A width less than 1/10 of the free space wavelength ensures that the reactive edge treatment is electrically small, but other criteria may be used as well. The width is the shorter dimension of the substrate. In the embodiment of FIG. 6, the width of the substrate contains three patches.

Figure 1:
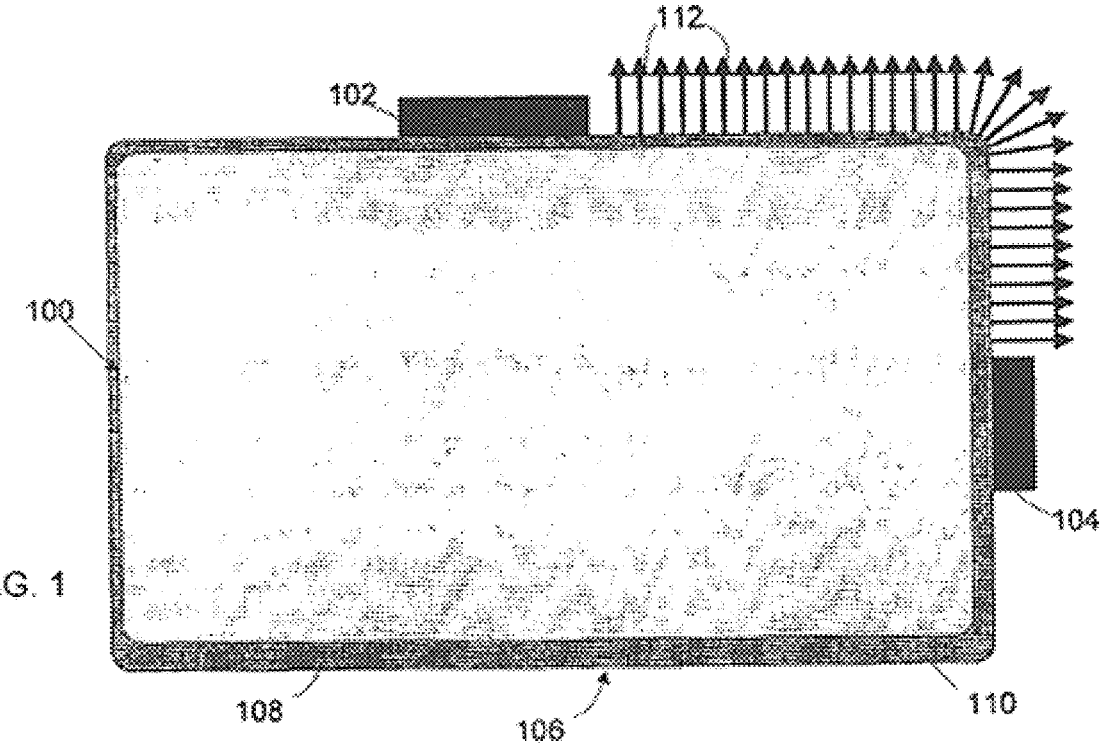
FIG. 1 illustrates coupling of energy between antennas mounted on a mobile device.
Figure 7:
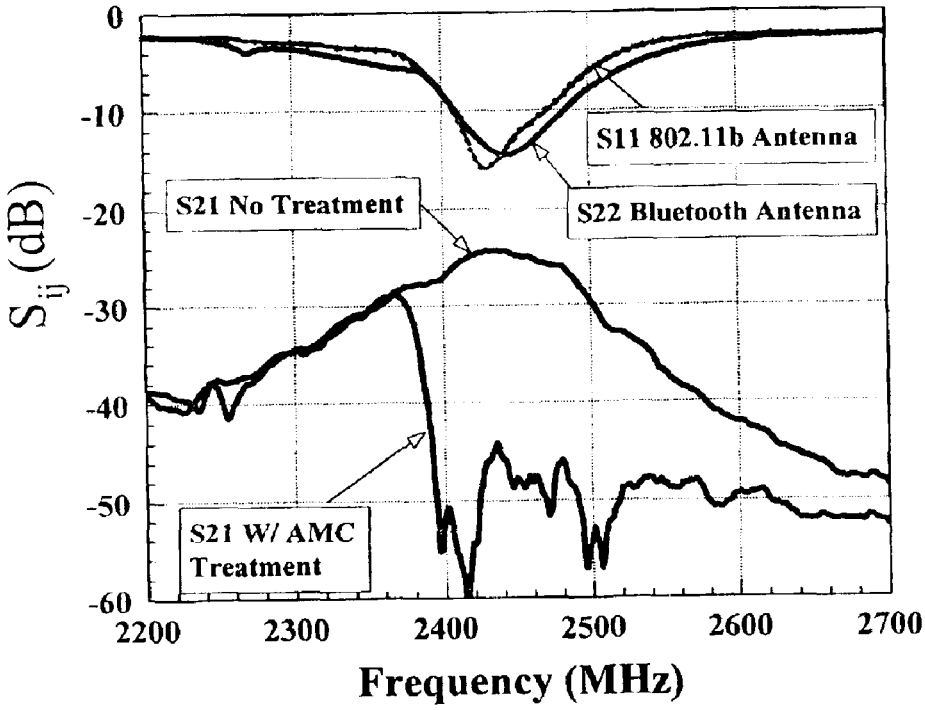
FIG. 7 illustrates return loss and mutual coupling data for an 802.11b antenna and a Bluetooth antenna positioned on a surrogate laptop computer similar to the arrangement of FIG. 1, with and without AMC edge treatment fabricated in accordance with the embodiment of FIGS. 4–6.

FIG. 7 illustrates return loss and mutual coupling data for an 802.11b antenna and a Bluetooth antenna, both positioned along the edge of a surrogate laptop computer screen, similar to the arrangement of FIG. 1, with and without AMC edge treatment fabricated in accordance with the embodiment of FIGS. 4–6. The surrogate laptop was machined from two pieces of aluminum. The first section was an open cavity forming the housing for a display screen. This piece was joined via a piano hinge to a second section, a metal keyboard base. There was no screen or plastic keyboard attached to the surrogate laptop during testing. Two 2.4 GHz AMC antennas were mounted on the top and side of the 16 mm wide screen housing in the surrogate laptop, similar to the arrangement shown in FIG. 1. Each AMC antenna had dimensions 37×12×3.4 mm and was fed by a 300 mm coaxial cable. The coupling (S12) between the antennas was measured with and without the AMC edge treatment as shown in FIG. 1. Each section of AMC edge treatment was 55×12×2.5 mm. As can be seen in FIG. 7, without edge treatment, the isolation between the Bluetooth antenna and the 802.11b antenna is approximately 25 dB. As seen in FIG. 7, the AMC edge treatment in this experimental setup improves isolation to approximately 45 dB or more over a 300 MHz bandwidth including the 802.11b band.

Figure 8:
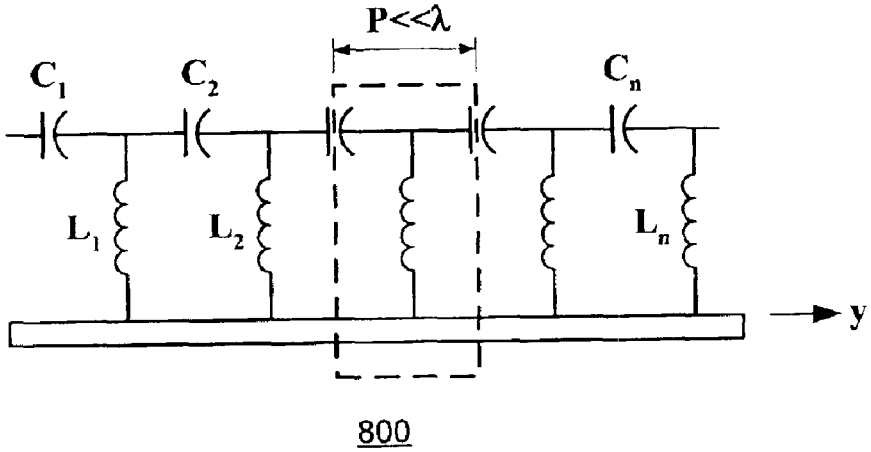
FIG. 8 is an equivalent circuit for the reactive edge treatments described herein.

FIG. 8 is an equivalent circuit 800 for the reactive edge treatments described herein. In the most general terms, the reactive edge treatment has an equivalent circuit 800 including an LC ladder network of series capacitors $C_1, C_2, \ldots C_n$, and shunt inductors $L_1; L_2, \ldots L_n$ to ground as shown in FIG. 8. The reactive edge treatment in accordance with these embodiments is a periodic structure in the y direction where the period P is much less than a free space wavelength $\lambda$ for the frequencies at which the edge currents are cutoff.

In the disclosed embodiments, the values of capacitors $C_n$ and inductors $L_n$ are uniform. However, there are special cases where it may be desirable to design a non-uniform ladder network. One such reason is to obtain a broader bandwidth for the suppression of edge currents. This may be possible by designing the $L_nC_n$ product to vary monotonically with position along the edge. Another reason for a non-uniform distribution is to obtain multiple bands for suppression of edge currents. This may be possible by maintaining a periodic ladder network, but to design adjacent LC pairs to have a different product.

There is a variety of ways to realize the reactive edge treatment described above. One embodiment is simply a narrow conventional multi-layer printed circuit board (PCB). A second embodiment is realized as a single-layer PCB that is essentially coplanar to the treated edge. A third embodiment involves a folded sheet metal or flexible substrate concept. In all embodiments, the width of the edge and edge treatment is electrically small.

One class of embodiments to realize the desired equivalent circuit of FIG. 8 employs conventional rigid or flex-rigid printed circuit boards. Examples of these embodiments are described in conjunction with FIGS. 9–11 below. These figures omit the dielectric regions for the sake of clarity. All structures shown are intended to be good conductors. Where parallel plates are shown, it is implied that a thin dielectric laminate separates the plates.

Figure 9:
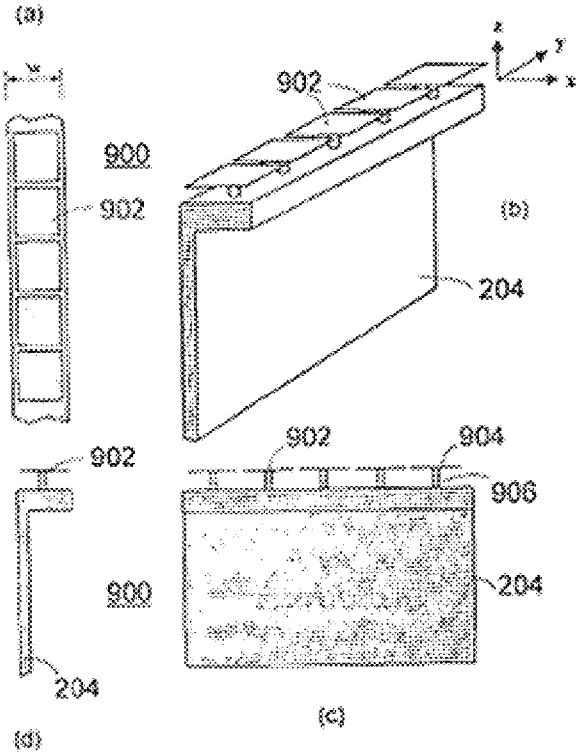
FIG. 9 illustrates a reactive edge treatment formed of a linear array of thumbtacks.

FIG. 9 illustrates a reactive edge treatment 900 formed of a linear array of thumbtacks 902. FIG. 9(*a*) is a top view of the edge treatment 900. FIG. 9(*b*) is an isometric view of the edge treatment 900. FIG. 9(*c*) is a first elevation view of the edge treatment 900. FIG. 9(*d*) is a second elevation view of the edge treatment 900. The embodiment of FIG. 9 illustrates a relatively simple embodiment where thumbtacks 902 or similarly shaped conductive elements are arranged linearly along the edge 204. Each thumbtack 902 includes a plate 904 and a post 906. In accordance with the equivalent circuit 800 of FIG. 8, series capacitance $C_n$ is realized with edge-to-edge capacitance between adjacent plates 904 of the thumbtacks 902, as can be seen in FIG. 9(*c*). The shunt inductance $L_n$ is realized with the posts 906 or vias extending from the center of the patches or plates 904 to the conductive edge 204. It will be appreciated that the row of thumbtacks 902 can be chosen to have any appropriate length. Also, the row of thumbtacks 902 may be arranged instead as a two dimensional array of thumbtacks. The geometries of the edge treatments illustrated herein may be chosen to satisfy particular design requirements.

Figure 10:
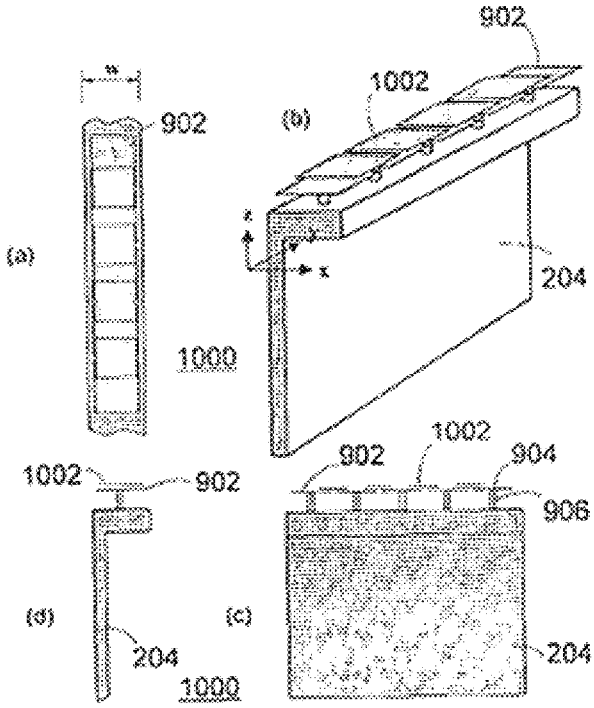
FIG. 10 illustrates another embodiment of a printed circuit reactive edge treatment employing overlapping patches to raise series capacitance.

FIG. 10 illustrates another embodiment of a printed circuit reactive edge treatment. FIG. 10(*a*) is a top view of the edge treatment 1000. FIG. 10(*b*) is an isometric view of the edge treatment 1000. FIG. 10(*c*) is a first elevation view of the edge treatment 1000. FIG. 10(*d*) is a second elevation view of the edge treatment 1000.

The reactive edge treatment 1000 is similar in construction to the edge treatment 900 of FIG. 9. The edge treatment 900 includes a first layer of patches and a second layer of patches. The first layer of patches includes thumbtacks 902 which include plates 904 and posts 906. In the embodiment of FIG. 10, the second layer of patches is employed to increase the series capacitance between respective thumbtacks. Thus, the edge treatment 1000 includes a series of thumbtacks 902 and overlapping patches 1002. The patches 1002 overlap a portion of each of two linearly disposed thumbtacks 902. As noted above in conjunction with FIG. 9, the linear array of thumbtacks illustrated in FIG. 10 may be replaced with a two-dimensional array of thumbtacks. In that case, the patches 1002 of the second layer of patches may overlap two, three, four or more patches of the first layer. Alternatively, the posts 906 could be designed to connect to top patches 1002 instead of lower level patches 904, or to both sets of patches.

FIG. 11 illustrates another embodiment of a printed circuit reactive edge treatment 1100. FIG. 11(*a*) is a top view of the edge treatment 11. FIG. 11(*b*) is an elevation view of the edge treatment 1100. The edge treatment 1100 of FIG. 11, including the thumbtacks 902, is substantially similar to the edge treatment 900 of FIG. 9. In this embodiment, chip capacitors 1102 are added between adjacent patches 902. For example, the chip capacitors may 1102 be added by soldering them to the patches 902. Conventional surface mount chip capacitors and manufacturing techniques may be used to implement the embodiment of FIG. 11. The chip capacitors operate to increase the series capacitance between respective patches, and hence lower the TM mode cutoff frequency.

FIG. 12 illustrates a reactive edge treatment 1200 that uses interdigital capacitors to raise the series capacitance between adjacent patches. FIG. 12(*a*) is a top view of the reactive edge treatment 1200. FIG. 12(*b*) is a first elevation view of the reactive edge treatment 1200. FIG. 12(*c*) is a second elevation view of the reactive edge treatment 1200. The edge treatment 1200 includes a plurality of thumbtacks 1202. Each thumbtack 1202 includes a plate 1202 and a post 1204 or via. As can be seen in FIG. 12(*a*), the adjoining edges 1208, 1210 of adjacent plates 1202 are interdigitated to increase the series capacitance between the adjacent plates. That is, fingers of metallization extend from the respective plates in patterns which are adjacent to the metallization from adjacent plates. The pattern of interdigitation illustrated in FIG. 12 is exemplary only. Any suitable pattern may be chosen to tailor the series capacitance to particular values. While the interdigitation pattern is shown as identical and mirrored from plate to plate, any pattern may be chosen for the interdigitated metallization.

Many factors will determine the effectiveness of a reactive edge treatment designed to implement the equivalent circuit of FIG. 8. Factors include the type and location of the antennas intended to be isolated. There will be multiple coupling paths, and the edge treatments are effective at mitigating the flow of currents along one of those paths. Other factors include the LC product, which will be inversely proportional to the cutoff frequency, and the L/C ratio, which will influence the bandwidth over which high attenuation is achieved.

Figure 13:
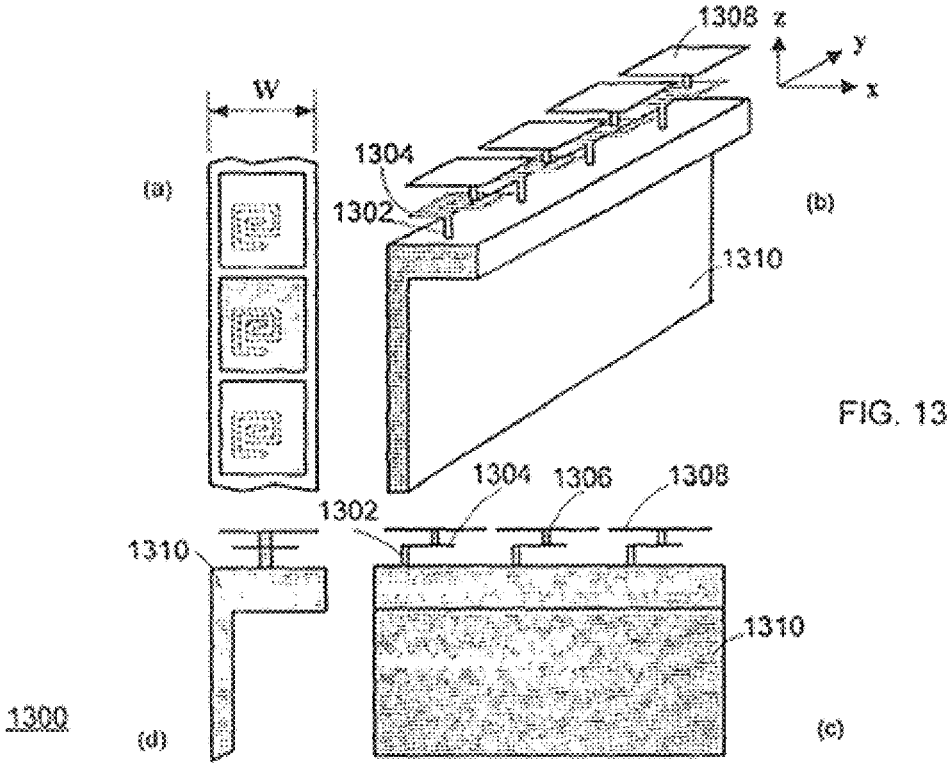
FIG. 13 illustrates a printed circuit edge treatment with an intermediate layer of metal between the patches and a radio frequency backplane to accommodate a spiral inductor.

FIG. 13 illustrates a printed circuit edge treatment 1300 with an intermediate layer of metal between the patches and a radio frequency backplane to accommodate a spiral inductor. This embodiment of a PCB edge treatment involves a more sophisticated shunt inductance. The edge treatment 1300 of FIG. 13 employs a three layer AMC in which the FSS capacitance is traded off in favor of enhanced shunt inductance. The LC product, which defines the cutoff frequency, can remain constant. This can be accomplished by using only one metal layer for capacitive patches, and then moving the middle layer of metal to near the center of the printed circuit structure to realize a printed trace of a loop or spiral inductor in series with the post or via.

An illustration of this idea is shown in FIG. 13. FIG. 13(*a*) is a top view of the edge treatment 1300. FIG. 13(*b*) is an isometric view of the edge treatment 1300. FIG. 13(*c*) is a first elevation view of the edge treatment 1300. FIG. 13(*d*) is a second elevation view of the edge treatment 1300. The edge treatment 1300 includes a first post 1302, a planar spiral 1304, a second post 1306 and a plate 1308. The first post 1302 electrically contacts the conductive edge 1310 at a first end and the planar spiral 1304 at the other end. The planar spiral 1304 may have any shape and the shape may be tailored to provide a particular inductance. The second post 1306 electrically contacts the planar spiral 1304 at one end and contacts the plate 1308 at the second end.

Figure 21:
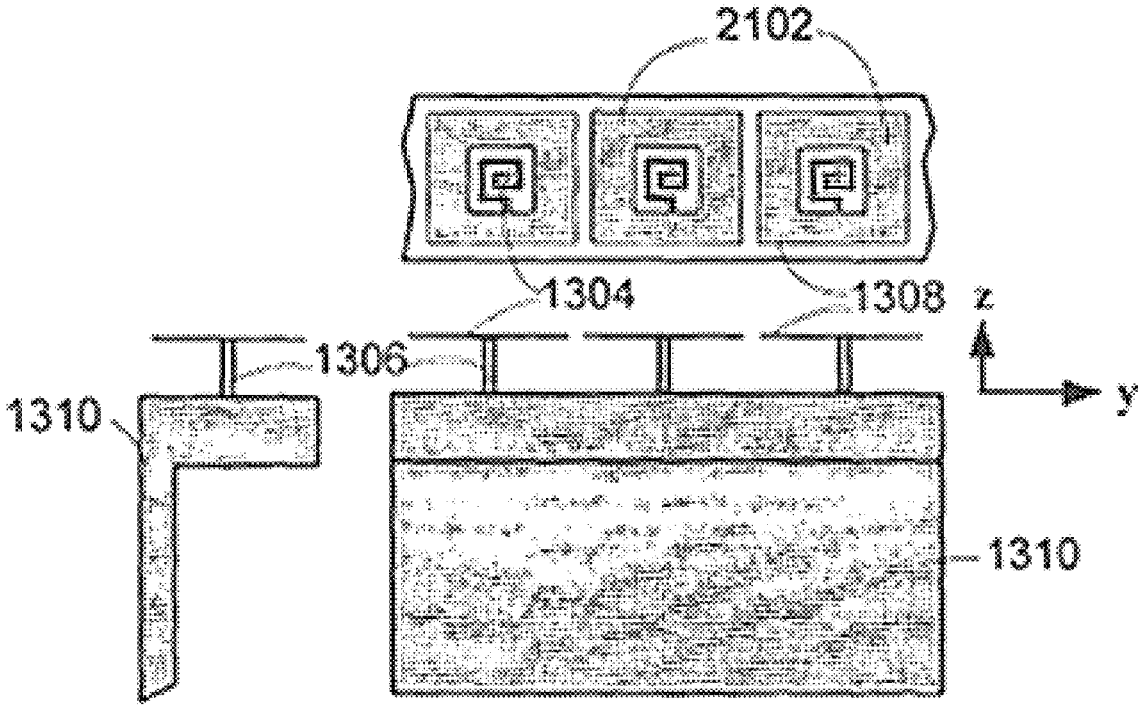
FIG. 21 shows a printed circuit treatment featuring spiral inductors on the same layer with patches as a variation on the embodiment of FIG. 13.

In an alternative embodiment to FIG. 13, FIG. 21 shows a printed circuit treatment featuring spiral inductors. The spiral inductor 1304 can be printed on the same layer as the patches 1308, as shown in FIG. 21. The spiral inductor 1304 may occupy an area at the center of the patch 1308 whereby the inside end of the spiral is connected to the post 1306, and the outside end of the spiral is connected to an annular ring 2102 which is the remainder of the patch. Thus, an intermediate layer of metal required for the embodiment of FIG. 13 can be removed from the PCB design in the embodiment of FIG. 21.

Thus, in the embodiment of FIG. 21, the reactive edge treatment includes one or more substantially planar arrays of conductive patches. Each patch includes the annular ring 2102 and a spiral inductor 1304. The spiral inductor 1304 is electrically positioned between the annular ring 2102 and a patch contact, where the inductor contacts the via. The via extends from the patch contact to electrically connect the patch to the electrically conductive edge 1310. In the illustrated embodiment, the annular ring 2102 and the spiral inductor 1304 are substantially coplanar.

As noted above, the edge treatment 1300 may be manufactured using FR4 insulating material. The metal spirals 1304 and plates 1308 can be printed on the surface of an FR4board. The posts 1302, 1306 can be drilled and plated. Other suitable manufacturing techniques can be used as well.

It has been shown that, by using a loop inductance in series with the PTH, no benefit is attained for increasing the reflection phase bandwidth of an AMC. However, it has also been shown that the roll off of the via inductance is inversely related to the TM mode cutoff frequency. A higher series inductance, such as that achieved by smaller diameter PTHs, will lower the TM mode cutoff frequency. Recently, in a paper on the mitigation of switching noise by using a high-impedance ground plane as the lower plate of a parallel plate waveguide, a printed inductor in series with the via was proposed, and claimed to offer greater bandwidth for suppression of the dominant LSM mode than what would have been achieved by using simple vias. So, this suggests increasing the shunt inductance for the equivalent circuit in FIG. 8 with the goal of increasing the bandwidth of an edge treatment.

It should be noted that one could integrate into one PCB edge treatment the capacitive features disclosed separately in FIGS. 10, 11 or 12 with the inductive features illustrated in FIG. 13. Combining features could lower the cutoff frequency for the edge or provide other electrical benefits.

Figure 14:
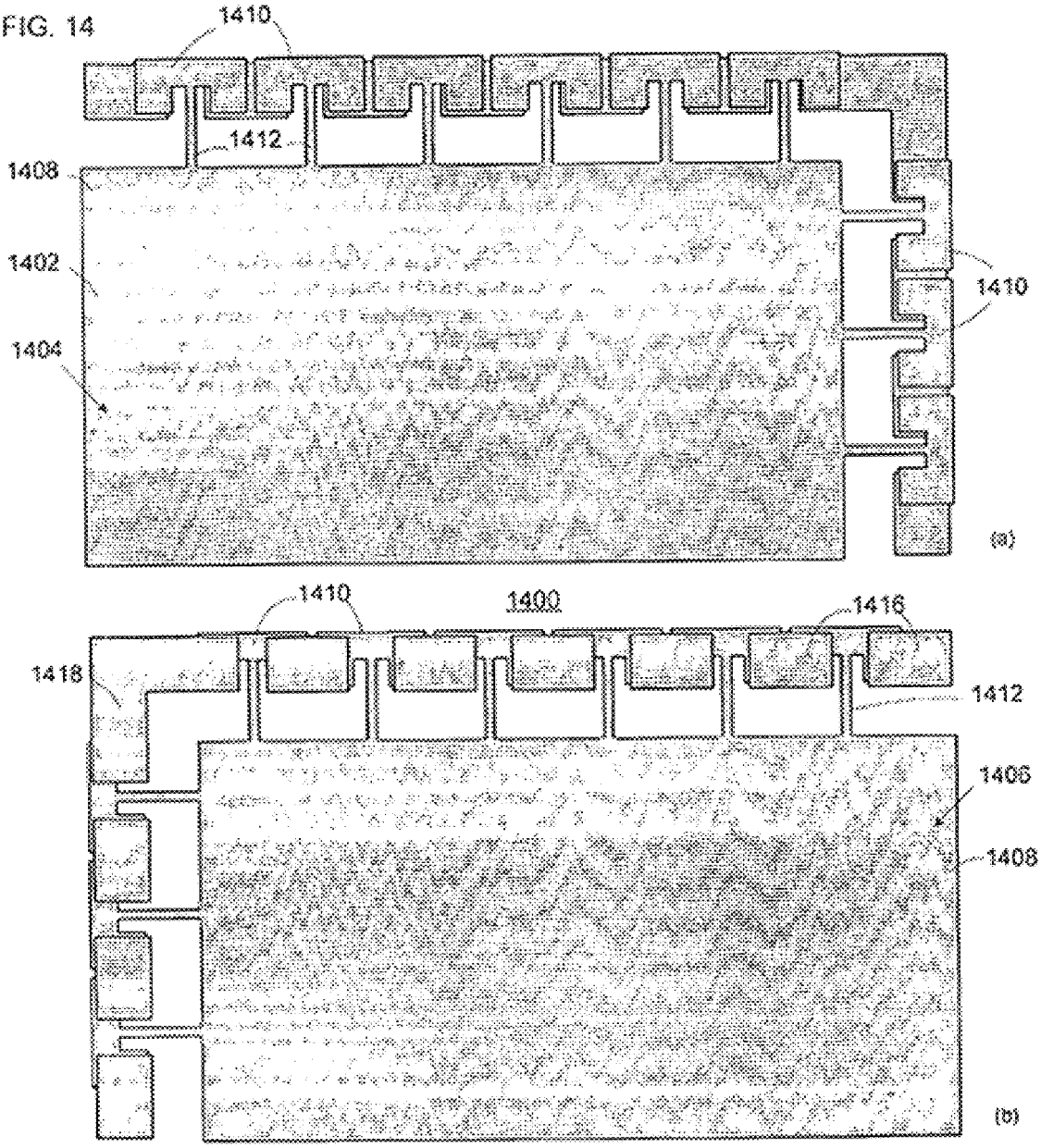
FIG. 14 illustrates a reactive edge treatment formed using a double sided flexible substrate.

FIG. 14 illustrates a reactive edge treatment 1400 formed using a double sided flexible substrate 1402. FIG. 14(*a*) shows the obverse side 1404 of the substrate 1402. FIG. 14(*b*) shows the reverse side 1406 of the substrate 1402. In this exemplary embodiment, the obverse side 1404 includes a central plate 1408 and peripheral patches 1410. The peripheral patches 1410 are electrically shorted to the central plate 1408 by shunt inductors 1412. The reverse side 1406 includes only peripheral patches 1416 and corner patch 1418. The peripheral patches 1416 and the corner patch 1418 of the reverse side 1406 are not shunted to the central plate 1408 but overlap the peripheral patches 1410 of the obverse side 1404 to increase the series capacitance of the reactive edge treatment 1400.

The edge treatment 1400 thus provides a virtually coplanar design using thin flexible substrate materials such as polyester or polyimide, with perimeter patches printed on both sides as overlapping plates. Typical substrate thicknesses are 2 mils up to 20 mils, which permit a significant series capacitance, up to a few picofarads. Shunt inductance is achieved by the narrow traces 1412 connecting the peripheral patches 1410 to the in-field ground plane, the central plate 1408. This ground plane can be capacitively coupled to the conductive edge through a thin laminate, such as pressure sensitive adhesive, or conductively attached through solder, clips, screws, conductive PSA, etc.

In FIG. 14, the inset feature, where the inductive strips 1412 contact each peripheral 1410 patch, is used to increase the shunt inductance since the inductance is essentially proportional to strip length. Thus, a lower profile edge treatment can be realized for a given cutoff frequency.

The conductive or metal surfaces for the embodiment shown in FIG. 14 can be an etched foil, such as copper or aluminum cladding, or a screen printed conductive ink. Alternatively, the conductive surface can be made from preprinted, highly conductive paints of the appropriate pattern.

Figure 15:
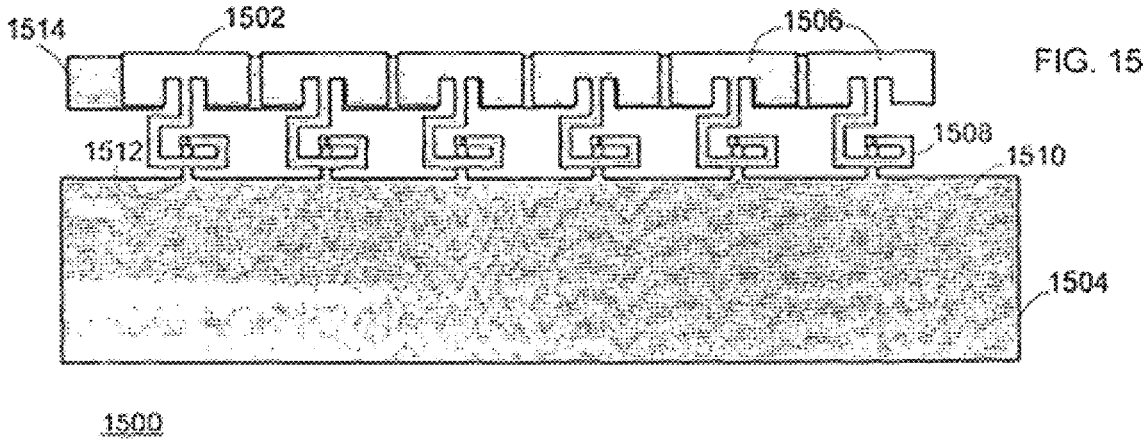
FIG. 15 illustrates a thin flexible reactive edge treatment with enhanced shunt inductance.

FIG. 15 illustrates a thin flexible reactive edge treatment 1500 with shunt inductance that is enhanced by printing spiral inductors between the patches and the conductive edge. The edge treatment 1500 is shown with the primary or near side metal layer 1502 overlapping the far side or secondary metal layer 1504. The primary side metal layer 1502 includes an array of patches 1506 with spirals 1508 extending therefrom. The secondary metal layer 1504 includes a central plate 1510 with tabs 1512 extending therefrom, as well as an array of patches 1514. The patches 1514 overlap the patches 1506, and the spirals 1508 overlap the tabs 1512 to make electrical contact using a via or plated through hole 1516.

Figure 20:
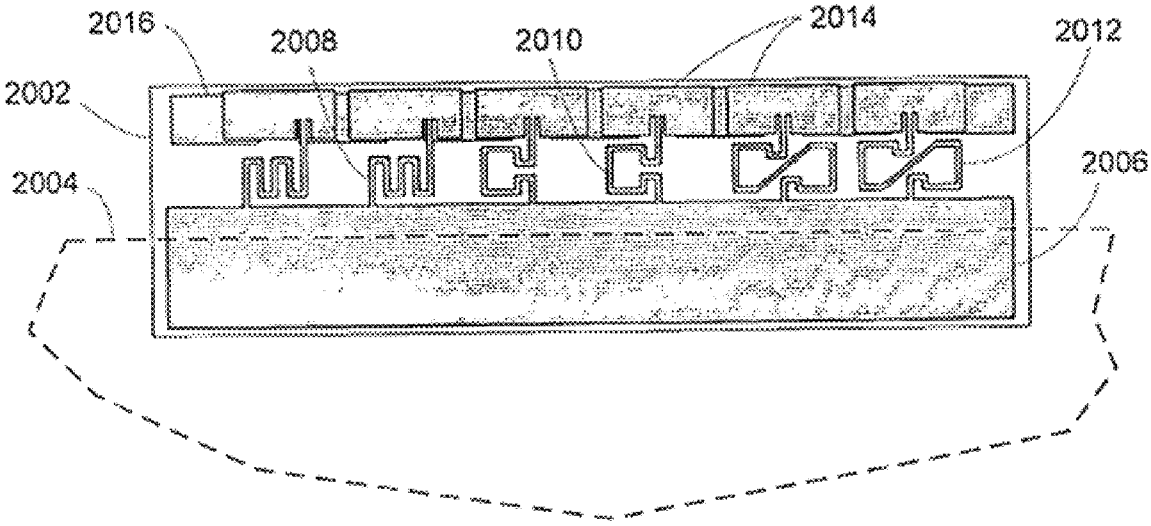
FIG. 20 illustrates additional embodiments of thin reactive edge treatments.

FIG. 20 illustrates additional embodiments of thin reactive edge treatments. Shown is a double-sided metalized substrate 2002 that is placed against a conductive edge 2004. The primary side of the substrate 2002 contains a central plate 2006, inductive traces 2008, 2010, and 2012, along with capacitive patches 2014. The secondary side contains only patches 2016, which overlap with patches 2014. The central plate 2006 may be capacitively or conductively coupled to the conductive edge 2004. For instance, the secondary side of the substrate 2002 may be adhesively attached to the edge 2004 to realize a low reactance capacitive path to the conductive edge.

FIG. 20 illustrates three different inductor designs. Trace 2008 is a meanderline inductor. Trace 2010 is a simple one-turn loop. Trace 2012 is a figure-of-eight loop. The purpose of each type of inductor is to enhance the shunt inductance in the equivalent circuit of FIG. 8. It is to be appreciated that other loops may be designed as well.

As shown in FIG. 20, patches 2014 and the central plate 2006 are coplanar. However, if the substrate 2002 is a thin flexible laminate such as polyester or polyimide, then the substrate 2002 may be folded or rolled to make a "D" shaped structure so as to orient the central plate and patches in separate but parallel planes. The central plate 2006 could be arranged at the bottom of the "D" while the overlapping patches 2014 and 2016 could be at the top of the "D". This folded edge treatment may be more effective at suppressing surface currents along wider edges than a planar (unfolded) edge treatment. In other embodiments, the substrate is flexible to orient the central plate in a first plane and the array of conductive patches in a second plane so that the second plane can be positioned relative to the first plane. In the example described above, the second plane is parallel to the first plane. In other examples, the planes may form any dihedral angle.

FIG. 16 illustrates assembly steps to create a narrow AMC edge treatment 1600 by folding a planar metal surface or lead frame 1602. The metal surface 1602 includes a central plate 1604 with a plurality of side patches 1606 extending therefrom in two arrays, on a first side of the central plate 1604 and a second side of the central plate 1604. The side patches 1606 are joined to the central plate 1604 by metal tabs 1608. Preferably, the metal surface 1602 can be cut or stamped or otherwise fabricated from a single sheet of conductive material. Any conductive material may be used. Copper is used in the exemplary embodiment of FIG. 16.

In this embodiment, the center of a stamped copper lead frame 1602 forms the RF backplane for a narrow AMC. Capacitive patches 1606 are attached on both sides using narrow strips or tabs 1608.

FIG. 16(*a*) shows the lead frame 1602 in a flat, unfolded configuration. FIG. 16(*b*) shows the lead frame 1602 after a first bending operation. FIG. 16(*c*) shows the lead frame 1602 after a second bending operation. FIG. 16(*d*) shows the lead frame 1602 after a third bending operation. FIG. 16(*d*) shows the lead frame 1602 after a fourth and final bending operation. FIG. 16(*e*) shows an elevation view of the lead frame 1602 after completion of the folding operations.

Assuming that a forming tool of rectangular cross section is placed along the center line of the lead frame 1602, the first two bending operations, FIGS. 16(*b*) and 16(*c*), fold one row 1610 of patches 1606 up and over the forming tool. Then a polyester film (not shown) is adhesively attached to the first row 1610 of patches 1606, and the remaining row 1612 of patches 1606 is bent up and over the first row 1610 using two more bending operations, FIGS. 16(*d*) and 16(*e*). The forming tool is then removed to leave a "hollow" AMC with a void 1614 defined between the patches 1606 on the top and the central plate 1604. The final assembly (less FSS dielectric) is shown in FIGS. 16(*e*) and 16(*f*). This AMC edge treatment 1600 may then be screwed, glued, taped, or clipped onto the metal edge of a laptop display or other edge to choke surface currents.

In alternative embodiments, the lead frame pattern of FIG. 16 may be etched on a metalized flexible substrate, such as polyester film, of desired thickness. The substrate may then be wrapped around a mandrel so as to realize the four bends required. In this embodiment, the flexible substrate becomes the FSS dielectric. Again, a PSA can be used to anchor the patches. In this alternative, thinner via traces can be used than with the bent metal approach illustrated in FIG. 16 because the polyester film is used as a mechanical carrier. Thus, a higher via inductance is possible, which yields a lower cutoff frequency for the AMC treatment. Furthermore, meanderline inductors or even spiral inductors can be printed on the flexible substrate to increase the shunt inductance.

An experimental effort was undertaken to quantify the additional isolation possible by using one-cell wide AMC materials as reactive edge treatments, which is similar to what is shown in FIG. 10. The experiments employed strips of AMC materials as shown in FIG. 17. AMC strips were cut from seven AMC panels of different part numbers, as show in FIG. 17. Each AMC is a 3-layer flex-rigid PCB formed of a 0.093" FR4 core that is bonded to a 2 mil layer of polyimide. Strips are cut to be nominally 0.25" wide, except for strip number 2, which is nominally 0.16" wide. Each design has a different period or patch size or both, but all were designed to be isotropic surfaces with a square periodic lattice. Design number 5 (SQR 093A) has plated through holes (PTHs) contacting the center of hidden patches on layer 2 whereas all remaining six AMC designs had PTHs contacting the centers of outside, layer 1, patches only. Accordingly, design number 5 is the only treatment that had more that one PTH per unit cell of length.

The experimental setup used to measure transmission is shown in FIG. 18. Two electrically small loop probes were cabled to a network analyzer for S21 measurements. The probes were conductively attached by copper tape to opposite ends of a surrogate laptop computer screen that was fabricated from an aluminum plate measuring approximately 11.5" wide by 9.25" tall by 0.25" thick. The network analyzer was calibrated for 0 dB of isolation when no treatment was installed. Then a pair of identical 3" long AMC strips was attached to the 0.25" wide edge using double-sided copper tape, as shown in FIG. 18. Each edge treatment was located approximately 2" from one of the corners of the surrogate laptop screen.

Figure 19:
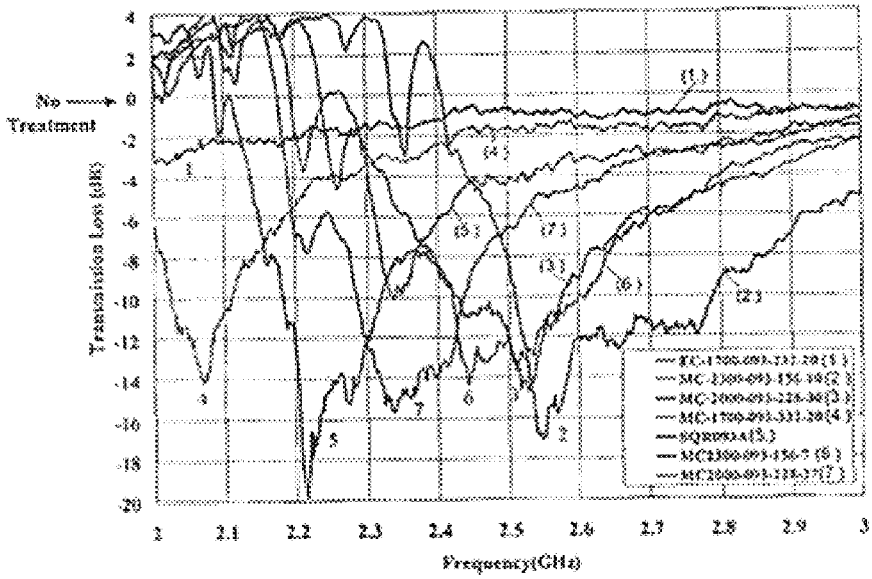
FIG. 19 shows isolation measurements for the seven reactive edge treatments illustrated in FIG. 17

Transmission measurements are shown in FIG. 19 for the seven reactive edge treatments shown in FIG. 17. For convenience, each curve is labeled with a number corresponding to the design shown in FIG. 7. Note that the reference level of 0 dB is for the case of no treatment installed.

The reactive edge treatments are seen to enhance coupling by a few dB below a certain cutoff frequency. By definition, the cutoff frequency is denoted to be the frequency where the transmission curve crosses 0 dB. Above the cutoff frequency, a nominal additional isolation of 10 dB or more can be observed for a frequency range of 100 to 300 MHz depending on the design of the edge treatment. All of the AMCs used in this experiment were designed to have a reflection phase resonance (as a large panel) between 1700 MHz and 2300 MHz. However, experience has shown that when narrow strips are cut from a given AMC panel to be used as edge treatments, the cutoff frequency is always significantly higher than the AMC resonant frequency. Hence, experimental measures such as this procedure are often used to evaluate the effectiveness of the edge treatment.

From the foregoing, it can be seen that the present embodiments provide an improved edge treatment for isolating two or more antennas, particularly adapted for use on a mobile device such as a laptop computer. The disclosed surface treatment does not absorb radio frequency energy, but re-directs energy away from the treated surface, is relatively light weight for mobile applications, and can be mass produced using mature manufacturing processes.

While a particular embodiment of the present invention has been shown and described, modifications may be made. Accordingly, it is therefore intended in the appended claims to cover such changes and modifications which follow in the true spirit and scope of the invention.

We claim:

1. A reactive circuit configured to inhibit the flow of electric currents along an edge of a conducting surface, the reactive circuit being characterizable as a ladder network of series capacitors at an outermost portion of the edge and shunt inductors that connect at least a subset of the series capacitors to the conducting surface, the ladder network having a periodic structure with period P which is much less than a free space wavelength $\lambda$ for frequencies at which edge currents are inhibited.

2. The reactive circuit of claim 1 further comprising:

an array of patches defining at least in part the series capacitors; and an array of orthogonal conductors electrically positioned between patches of the array of patches and the conducting surface and defining at least in part the shunt inductors.

3. The reactive circuit of claim 2 further comprising:

a second array of patches, each patch of the second array of patches overlapping adjacent patches of the array of patches to define at least in part the series capacitors.

4. The reactive circuit of claim 2 further comprising:

spiral inductors electrically positioned between patches of the array of patches and the conducting surface to define at least in part the shunt inductors.

5. A reactive edge treatment configured to be disposed on an electrically conductive edge, the reactive edge treatment comprising:

a substrate, the substrate having a width which is 1/10 of a free space wavelength at frequencies where the reactive edge treatment inhibits flow of edge currents in the electrically conductive edge, the substrate including a conductive backplane, one or more substantially planar arrays of conductive patches spaced from the conductive backplane, and an array of orthogonal conductors, each orthogonal conductor extending from a patch to connect the conductive backplane to at least one patch.

6. The reactive edge treatment of claim 5 wherein the one or more arrays of conductive patches comprises:

a first array of patches, each patch of the first array being electrically coupled to an orthogonal conductor.

7. The reactive edge treatment of claim 6 wherein the one or more arrays of conductive patches further comprises:

a second array of patches, each patch of the second array overlapping adjacent patches of the first array.

8. The reactive edge treatment of claim 6 further comprising capacitors enhance series capacitance between adjacent patches of the first array of patches.

9. The reactive edge treatment of claim 6 further comprising chip capacitors between adjacent patches of the first array of patches.

10. The reactive edge treatment of claim 6 further comprising interdigitated capacitors between at least some adjacent patches of the first array of patches.

11. The reactive edge treatment of claim 5 wherein at least some orthogonal conductors include inductance enhancements between the patch and the conductive backplane.

12. The reactive edge treatment of claim 5 further comprising:

spiral inductors associated with at least some of the orthogonal conductors and positioned between the patch and the conductive backplane.

13. A reactive edge treatment configured to be disposed on an electrically conductive edge, the reactive edge treatment comprising:

a flexible substrate;

a first central plate and a first array of patches disposed on an obverse side of the flexible substrate, patches of the first array of patches being electrically coupled to the first central plate; and a second array of patches disposed on a reverse side of the flexible substrate, patches of the second array of patches being positioned to overlap adjacent patches of the first array.

14. The reactive edge treatment of claim 13 further comprising spirals extending from the patches of the second array of patches.

15. A reactive edge treatment configured to be disposed on an electrically conductive edge, the reactive edge treatment comprising:

a printed circuit including a conductive radio frequency (RF) backplane, one or more substantially planar arrays of conductive patches located at fixed distances from the RF backplane, and an array of plated through holes, each hole being generally centered on a patch of at least one of the planar arrays of conductive patches, the plated through holes connecting the RF backplane to the at least one array of patches, the reactive edge treatment having a width which is less than 1/10 of a free space wavelength at frequencies where the reactive edge treatment inhibits flow of edge currents in the electrically conductive edge.

16. The reactive edge treatment of claim 15 further comprising a dielectric layer spacing the backplane and the one or more planar arrays.

17. The reactive edge treatment of claim 15 wherein the one or more arrays of conductive patches comprises:

a first may of patches, each patch of the first array being electrically coupled to a plated through hole; and a second array of patches, each patch of the second array overlapping adjacent patches of the first array.

18. The reactive edge treatment of claim 17 further comprising capacitors to enhance series capacitance between adjacent patches of the first array of patches.

19. The reactive edge treatment of claim 17 further comprising inductors to enhance shunt inductance between at least some patches of the first array of patches and the backplane.

20. A method for manufacturing a reactive edge treatment, the method comprising:

forming a planar metal lead frame having a center strip and a row of patches, connected to the center strip through tabs on one or both sides of the center strip; and folding each row of patches into a secondary plane, the secondary plane being substantially parallel to the center strip, through two successive bends of the connecting tabs.

21. The method of claim 20 further comprising: connecting the center strip to a conductive edge.

22. The method of claim 20 further comprising the integration of loop inductors or meanderline inductors into the tabs.

23. A reactive edge treatment configured to be disposed on an electrically conductive edge, the reactive edge treatment comprising:

a flexible substrate;

on a first side of the substrate, a central plate and an array of conductive patches, each conductive patch separated from the central plate by an inductive trace; and on a second side of the substrate, a plurality of conductive patches positioned to at least partially overlap patches of the array of conductive patches, the substrate being flexible to orient the central plate in a first plane and the array of conductive patches in a second plane, the second plane having a predetermined orientation relative to the first plane.

24. The reactive edge treatment of claim 23 wherein the second plane is substantially parallel to the first plane.

25. A reactive edge treatment configured to be disposed on an electrically conductive edge, the reactive edge treatment comprising:

one or more substantially planar arrays of conductive patches, each patch including an annular ring portion and a spiral inductor portion, the spiral inductor portion electrically positioned between the annular ring portion and a patch contact, and an array of conductive vias, each conductive via extending from a patch contact of a patch to electrically connect the patch to the electrically conductive edge.

26. The reactive edge treatment of claim 25 wherein the annular ring portion and the spiral inductor portion are substantially coplanar.

* * * * *